US007913624B2

(12) United States Patent
Mitchell

(10) Patent No.: US 7,913,624 B2
(45) Date of Patent: Mar. 29, 2011

(54) EXPLOSIVE MATRIX ASSEMBLY

(75) Inventor: Jon K. Mitchell, Glen Allen, VA (US)

(73) Assignee: The United States of America as represented by the Attorney General, Washington, DC (US)

( * ) Notice: Subject to any disclaimer, the term of this patent is extended or adjusted under 35 U.S.C. 154(b) by 259 days.

(21) Appl. No.: 12/408,300

(22) Filed: Mar. 20, 2009

(65) Prior Publication Data

US 2009/0301335 A1 Dec. 10, 2009

(51) Int. Cl.
*C06C 5/04* (2006.01)

(52) U.S. Cl. ..... 102/275.8; 102/403; 102/275.7; 89/1.13

(58) Field of Classification Search ..... 102/275.1, 102/275.2, 275.3, 275.4, 275.5, 275.6, 275.7, 102/275.8, 402, 403; 89/1.13
See application file for complete search history.

(56) References Cited

U.S. PATENT DOCUMENTS

| | | | | |
|---|---|---|---|---|
| 2,455,354 | A | 12/1948 | Bisch | |
| 3,242,862 | A | 3/1966 | Stegbeck et. al. | |
| 3,789,759 | A * | 2/1974 | Jones | 89/1.14 |
| 4,768,417 | A | 9/1988 | Wright | |
| 4,817,787 | A * | 4/1989 | Owen | 206/3 |
| 4,823,672 | A * | 4/1989 | Eidelman | 89/1.13 |
| 5,005,694 | A * | 4/1991 | Davis et al. | 206/3 |
| 5,437,230 | A | 8/1995 | Harris et al. | |
| 5,524,524 | A | 6/1996 | Richards et al. | |
| 5,675,104 | A | 10/1997 | Schorr et al. | |
| 6,182,553 | B1 | 2/2001 | Peterson | |
| 7,000,545 | B2 * | 2/2006 | Sansolo | 102/331 |
| 7,410,049 | B2 * | 8/2008 | O'Brien et al. | 206/3 |

OTHER PUBLICATIONS

U.S. Navy, Distributed Explosive Technology (DET) Mine Clearance System (MCS) Ex 10 Mod 0 Program Life Cycle Cost Estimate for Milestone III, Jun. 4, 1999, 15 pages.*

U.S. Navy, DET MCS Drawing 5620137, "Panel Assembly, Mid," 4 pages, entered into evidence as Exhibit Q in, *Wright* v. *United States*, 53 Fed. Cl. 466 (2002).*

U.S. Navy, DET MCS Drawing 5620143, "Panel Assembly, Aft," 8 pages, entered into evidence as Exhibit R in, *Wright* v. *United States*, 53 Fed. Cl. 466 (2002).*

U.S. Navy, DET MCS Drawing 5620800, "Panel Assembly, Fwd," 4 pages, entered into evidence as Exhibit S in, *Wright* v. *United States*, 53 Fed. Cl. 466 (2002).*

U.S. Navy, DET MCS Drawing 5620810, "Array Assembly," 10 pages, entered into evidence as Exhibit T in, *Wright* v. *United States*, 53 Fed. Cl. 466 (2002).*

* cited by examiner

*Primary Examiner* — Michael Carone
*Assistant Examiner* — Gabriel J Klein
(74) *Attorney, Agent, or Firm* — Robert G. Hilton; Gary L. Hausken; John Fargo

(57) ABSTRACT

An explosive matrix assembly is provided in which a single detonating cord is configured into a first set of at least five parallel sets of paired portions lying in the same plane, with adjacent parallel pairs being spaced about two inches apart. The detonating cord is further configured so that there is a second set of at least five more parallel portions that are substantially orthogonal to the first set and that lie on top of the first set. Finally, the detonating cord is further configured so that there is a pair of portions that operably secure the matrix to an appropriate explosive initiator.

4 Claims, 6 Drawing Sheets

EXPLOSIVE MATRIX ASSEMBLY

FEDERALLY SPONSORED RESEARCH AND DEVELOPMENT

The invention claimed herein was made using resources and funds of the United States of America, and all rights to the invention are assigned to the United States of America, as represented by the Attorney General.

FIELD OF THE INVENTION

The present invention relates to explosives which are used to neutralize target explosives.

BACKGROUND OF THE INVENTION

Explosives disposal operations are inherently dangerous. Bomb technicians are more likely to be killed or injured while conducting an explosives disposal operation than any other mission, including attempting to render an improvised explosive device (bomb) inoperative.

Effective and efficient explosive disposals require a technician to safely deploy an explosives counter charge that maximizes the target surface area for a given net explosive weight (N.E.W.) of the explosives counter charge. The higher the N.E.W. of the explosives, the greater the risk of injury and collateral property damage. The greater the common surface area that the explosives counter charge has with the disposal target, the more likely the disposal target will be completely consumed. Efficient counter charge explosives must possess a sufficiently high detonation velocity in order to create a suitable cutting and thermal effect. These requirements are difficult to satisfy.

The general concept of using detonating cord to make an explosive matrix as an explosive counter charge is well known, as exemplified by U.S. Pat. Nos. 2,455,354; 3,242,862; 4,768,417; 5,437,230; and 6,182,553; and by the U.S. Navy's Distributed Explosives Technology, described in "Distributed Explosive Technology (DET) Mine Clearance System (MCS) Ex 10 Mod 0 Program Life Cycle Cost Estimate for Milestone III" (Jun. 4, 1999). These prior designs were created for large military applications. Such applications require significant manpower and financial resources. These prior art explosive matrices must be manufactured well in advance of their usage. Field assembly is not practical because they are a complex of multiple lengths of detonating cords joined together.

In addition, prior art explosive matrices are heavy and cumbersome to transport. They use rope or cord to hold the detonating cord together, creating undesirable bulk and weight.

Furthermore, detonating cord functions linearly. As a result, detonating cord can fail to propagate the detonation wave where the cord makes sharp turns, especially when large grain detonating cord is used. In some prior art designs, in order to assure sufficient transfer of the detonating wave between intersecting cords, clamps were used at all points of intersection of detonating cord. This adds further complexity and bulk to these prior art designs.

Moreover, use of low grain non-propagating detonating cord is not always possible in prior designs. Some prior art devices initiate at one point, in one direction, and use multiple lengths of detonating cord, which compromises reliability. Other prior art incorporates multiple initiation points and multiple lengths of detonating cord, again making the design more complex and the assembly more complicated and expensive.

In the past, the explosive charges used to counter individual explosives, such as roadside bombs, were point explosives. Generally, these devices were originally designed for some purpose other than explosives disposal, such as commercial blasting or military demolition. Many of these adapted designs are time consuming to construct and require large amounts of N.E.W. to be effective, resulting in greater risk of injury and unintended damage. Lastly, many of such explosives are costly and difficult to acquire.

BRIEF SUMMARY OF THE INVENTION

The present Explosive Matrix design can be easily, quickly, safely, reliably, and affordably prepared in the field and deployed by a single explosives operator. The explosive matrix assembly according to the present invention permits the construction of explosives counter charges which are more efficient, safer and less costly than counter charges heretofore used. It is versatile, permitting adaptation to many different explosives disposal scenarios.

Explosive charges according to the present invention may be pre-assembled and stored in a flat and stacked manner. They also may be deployed by robot. Such preassembly and robot deployment significantly reduces the time that technicians are exposed to the hazards associated with explosives disposal. However, charges according to the present invention also may be assembled in the field using the novel Explosive Matrix Field Assembly Tool, a simple loom-type assembly tool. This reduces the need to anticipate the number of nets that will be needed over any period of time, and will eliminate the need to store such pre-assembled nets. It will also permit the user to simply purchase commercially available detonating cord on an as-needed basis.

The present invention is typically assembled from a single length of detonating cord woven into a grid like matrix pattern, and a small number of cable ties and or tape that hold the assembly together. This construction eliminates the need for more complex connections at points of intersecting detonating cord. It does not use any rope or cord to hold the charge together.

In the present invention, both ends of a single detonating cord weave are located at the initiator; therefore, both ends of the single detonating cord weave are initiated at the same time from the same point. This bidirectional propagation of the charge ensures complete detonation, particularly when using large grain detonating cord.

Due to the concentration of at least 3 to 4 portions of detonating cord at every intersection throughout the matrix, the detonation wave is able to propagate through the entire matrix without having to turn sharp corners. This is beneficial when using detonating cord that fails to propagate the detonation wave through sharp turns. The reason that the detonating wave does not have to propagate perpendicularly at the 90-degree intersections is that there is a looped portion of detonating cord between the ends of adjacent parallel straight portions. The cable ties are not absolutely necessary for low grain non-propagating detonating cord although they are preferred. For the foregoing reasons, the present invention assures propagation of the detonation wave throughout the assembly, and permits use of virtually every weight of commercially available detonating cord, as well all military detonating cord.

The preferred paired-cord version of the present invention results in intersections of three to four straight portions of detonating cord, unlike prior known designs, which only have two such portions. This concentration creates points of increased net explosives, maximizing the effects of the explosives charge. The paired-cord version also maximizes the tensile and compression strength of deployed counter charges, reducing the chance of mission failure due to structural failure.

The present invention maximizes the surface area of the countercharge in relation to the target. It thus requires less N.E.W. to counter any given threat than prior art matrices. A smaller overall explosive charge minimizes the potential for unintended injury, death, and other collateral damage. Moreover, the overpressure created by the explosive matrix is in the form of a flat wave, thus allowing the explosive matrix to be located at a greater distance from the target explosive than is possible when the countering device consists essentially of a point explosive.

The present invention permits the user to adjust the N.E.W. of the charge by changing the geometry and the explosive strength of the detonating cord, without making the Explosive Matrix less effective. Many commonly-available detonating cord weights may be used. This allows the Explosive Matrix to be deployed with a variety of configurations, in a variety of situations and surroundings.

In addition, the surface area of the Explosive Matrix may be easily enlarged by using cable ties to join many smaller charges into larger charges. This also allows for easier storage until the need to deploy them arises.

DETAILED DESCRIPTION OF THE INVENTION

Figure 1:
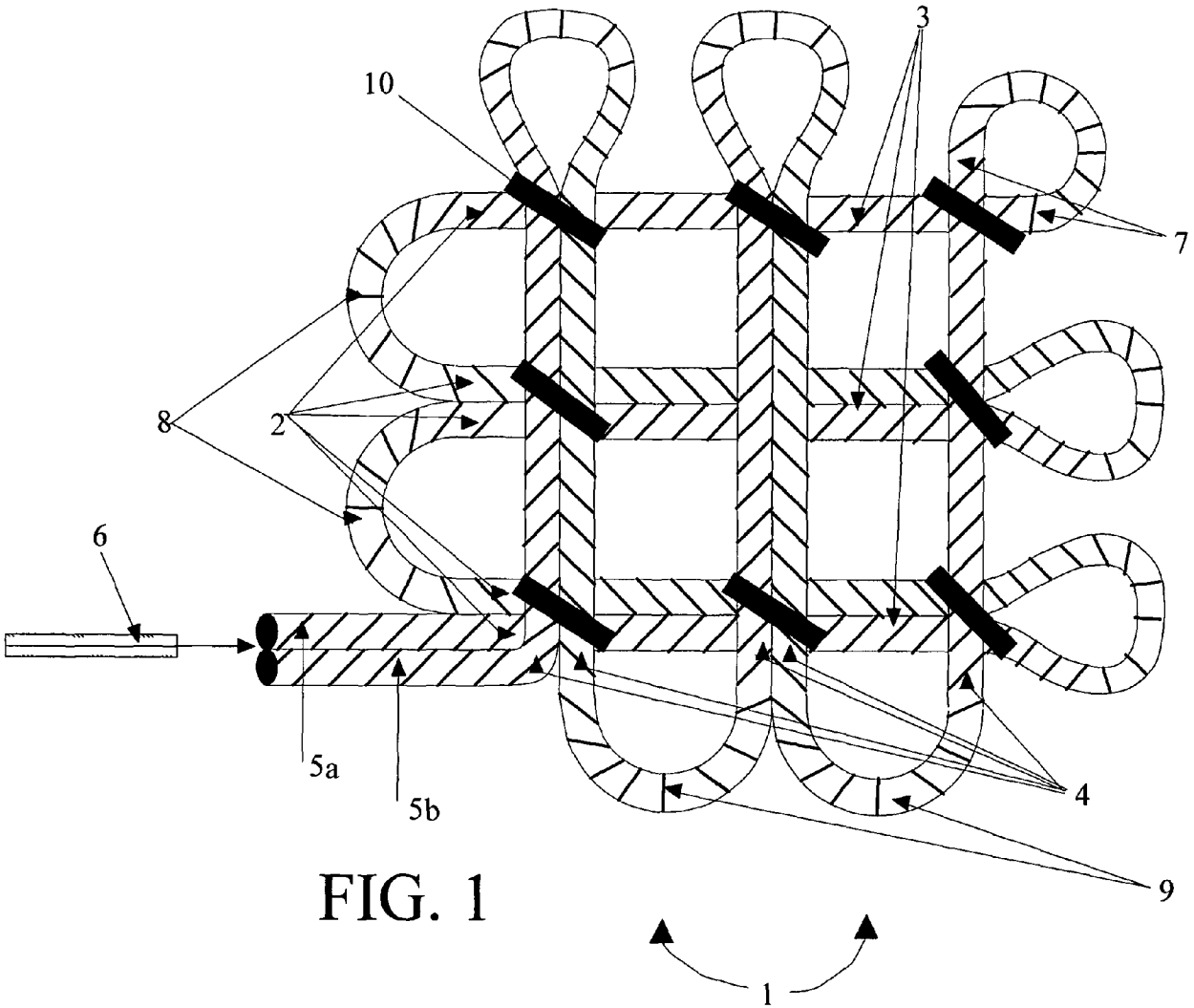
FIG. 1 depicts an explosive matrix assembly that is constructed according to the preferred embodiment of the present invention.

Referring to the drawings, FIG. 1 depicts a preferred embodiment of the explosive matrix assembly 1 according to the present invention. The explosive charge is provided by a single length of detonating cord 2 that is configured into a first set of at least five parallel straight portions 3 lying in a first plane. Four of the straight portions are paired into two pairs. There is a space, usually about two inches, separating the two pairs from each other, and about two inches separating the unpaired straight portion from the nearest paired straight portion. The detonating cord is further configured so that there is a second set of at least five more parallel straight portions 4 that are orthogonal to the first set and lying in a second plane. The second set of straight portions 4 are paired and spaced in a manner similar to the first set of straight portions 3. Finally, the detonating cord is further configured so that there are two portions, 5*a* and 5*b*, referred to herein as "tails," that are operably secured to an appropriate explosive initiator 6.

One of the tails 5*a*, which is operably secured to the explosive initiator 6, extends from the first set of parallel paired straight portions 3. The other tail 5*b* that is operably secured to the explosive initiator 6 extends from the second set of parallel straight portions 4. It is preferred that each of the two sets is comprised of an odd number of parallel straight portions. The reason for the odd number of parallel straight portions is so that a single looped portion of detonating cord 7 may run between the two sets of parallel detonating cords at a point that is diagonally across from the tails 5*a* and 5*b* that are operably secured to the initiator.

At each end of the parallel straight portions of detonating cord, there is a small looped portion 8 or 9 between the adjacent straight portions of detonating cord. Along each of the four outermost sets of parallel straight portions of detonating cord, there are cable ties 10 which secure those outermost sets with the intersecting orthogonal pairs of detonating cords. These cable ties 10 assist in holding the explosive matrix assembly together.

Figure 2:
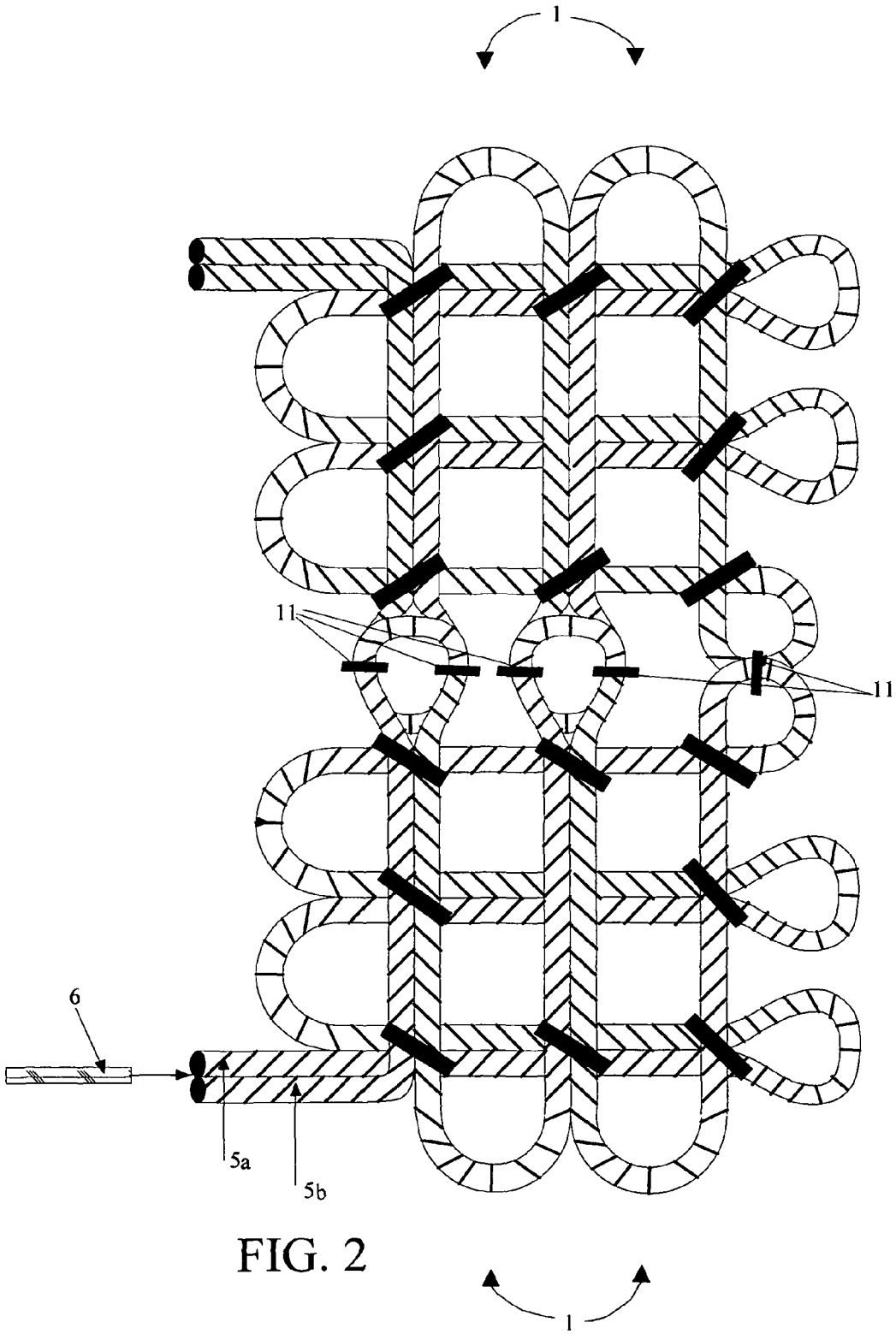
FIG. 2 depicts two explosive matrix assemblies according to the present invention, which are secured to each other for the purpose of countering an explosive occupying a larger area.
Figure 3:
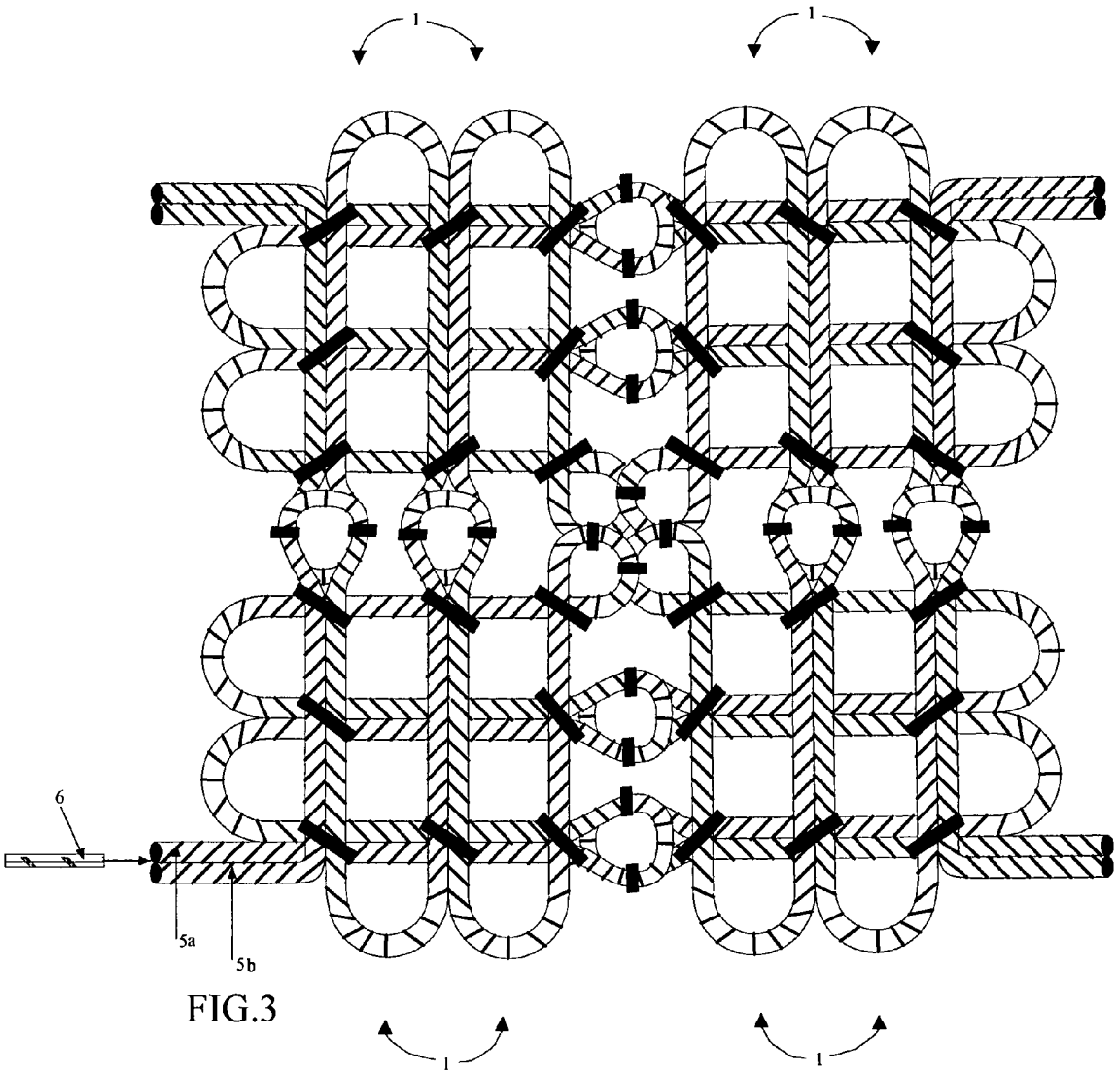
FIG. 3 depicts four explosive matrix assemblies according to the present invention, which are secured to each other for the purpose of countering an explosive occupying a larger area.

Typically, the perimeter of each explosive matrix assembly 1 roughly defines a rectangle of approximately four inches by four inches (if using the two 2-inch spacings between parallel straight lengths). If the explosive matrix must counter an explosive which lies under a larger area, either a larger matrix may be used or, preferably, two or more explosive matrix assemblies are secured to one another by additional cable ties 11, as depicted in FIG. 2 and FIG. 3. All explosive matrix assemblies so secured to one another are preferably initiated by the same initiator.

The detonation of the matrix produces an overpressure that defines a flat wave. The overpressure of the flat wave does not dissipate as the distance to the target explosive increases. Thus, the explosive matrix 1 need not abut the target explosive 12 and may be effective using a smaller overall explosive charge than would be needed if using a point explosive. Generally, there must be at least five straight portions of detonating cord in each direction in order to generate a flat wave which will not significantly dissipate its overpressure as it travels away from the matrix.

Figure 4:
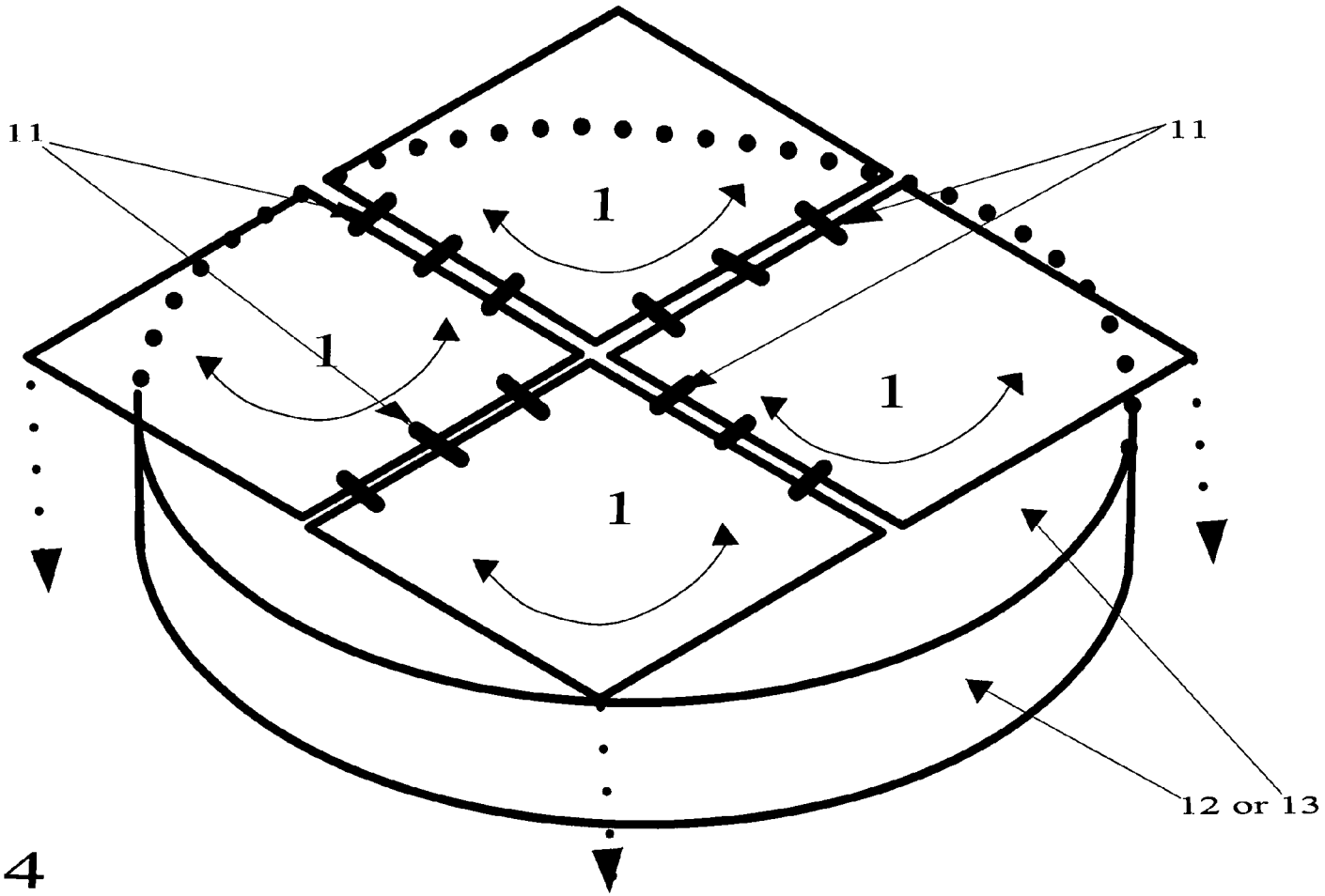
FIG. 4 is a schematic of four explosive matrix assemblies, secured to each other, covering a target explosive.

The first step in deploying the claimed invention is for the disposal technician to decide how large an explosive matrix area 13 is needed to completely cover the target explosive 12, as depicted in FIG. 4. If the area 13 to be used exceeds the area that can effectively be covered by a single explosive matrix, a sufficient number of explosive matrix assemblies will be made and secured to one another by additional cable ties 11 to cover the entire matrix area 13.

The technician then determines the sensitivity of the target and the explosive effort needed to insure complete consumption of the target. Using this information, the technician determines the N.E.W. of the counter charge needed to completely consume the target. The N.E.W. of the matrix charge is based on the areal size of the matrix charge and detonating cord grain weight. Charts or diagrams may be prepared to provide users of the matrix tool detailed information on the assembly of the matrix charge, the amount of detonating cord needed for a specific size matrix charge, and the N.E.W. for the matrix charge based on the grains per foot of detonating cord and the areal size of the matrix charge. The following are exemplary charts which may be used to provide such detailed information:

Example of Explosive Matrix Assembly Calculations

The following calculation for a 12"×12" Matrix demonstrates how the needed length of detonating cord is derived. A "weave" refers to a detonating cord that is stretched across the assembly tool. A "loop" refers to the detonating cord going around the protrusion on the assembly tool, thus causing a change in direction. The exemplary 12"×12" Matrix consists of a first set of 13 weaves, a second set of 11 weaves, 23 loops, and two 12" tails, requiring a total of 396.8 inches of detonating cord, as set forth below:

$$\begin{aligned} 13\ \text{weaves} \times 14'' &= 182'' \\ 11\ \text{weaves} \times 14'' &= 154'' \\ 23\ \text{loops} \times 1.6'' &= 36.8'' \\ 2\ \text{tails} \times 12'' &= 24'' \\ \hline & \ \ 396.8'' \end{aligned}$$

Using similar calculations for various matrix dimensions, the following are the lengths of detonating cord are required per matrix charge for various matrix dimensions:

| | 12" | 14" | 16" | 18" | 20" | 22" | 24" |
|---|---|---|---|---|---|---|---|
| 12" | 33' | 38' | 43' | 49' | 56' | 64' | 72' |
| 14" | 38' | 43' | 48' | 54' | 61' | 69' | 77' |
| 16" | 43' | 48' | 54' | 60' | 67' | 74' | 83' |
| 18" | 49' | 54' | 60' | 67' | 73' | 81' | 89' |
| 20" | 56' | 61' | 67' | 73' | 81' | 88' | 96' |
| 22" | 64' | 69' | 74' | 81' | 88' | 96' | 104' |
| 24" | 72' | 77' | 83' | 89' | 96' | 104' | 112' |

The above calculations are based on the use of the described Explosive Matrix Assembly Tool and the tightness of the weave. The exact length of the detonating cord needed to complete a Matrix may vary slightly, but this will not significantly affect the N.E.W. The size of the Matrix and the grain weight of the detonating cord should be based on the explosives disposal technician's evaluation of the target.

Example of Explosive Matrix Assembly TNT Conversion for PETN

The following exemplary calculation is for a 12"×12" Matrix using 80 grain PETN detonating cord. In most cases disposal technicians base the explosives energy of all explosives in relation to the explosives energy of TNT. The Relative Equivalence (RE) of PETN is 1.27, which means that one pound of PETN is equivalent to 1.27 pounds of TNT. Based on the below calculation a 12"×12" Matrix consisting of 33 feet of PETN detonating cord would be equivalent to 0.46 pounds of TNT. (33 Feet of Detonating Cord×0.011 Grains per Pound=0.36 Pounds per Matrix Charge, 0.36 Pounds per Matrix Charge×1.27 RE=0.46 TNT Equivalent) The below chart shows that as the size of the Matrix increases, so does the explosives energy in pounds of TNT.

TNT Equivalent for 80 Grain Matrix Charge (1.27 RE)

| | 12" | 14" | 16" | 18" | 20" | 22" | 24" |
|---|---|---|---|---|---|---|---|
| 12" | 0.46 | 0.52 | 0.60 | 0.69 | 0.79 | 0.89 | 1.0 |
| 14" | 0.52 | 0.60 | 0.67 | 0.75 | 0.85 | 0.97 | 1.1 |
| 16" | 0.60 | 0.67 | 0.75 | 0.84 | 0.94 | 1.0 | 1.2 |
| 18" | 0.69 | 0.75 | 0.84 | 0.94 | 1.0 | 1.1 | 1.2 |

-continued

TNT Equivalent for 80 Grain Matrix Charge (1.27 RE)

| | 12" | 14" | 16" | 18" | 20" | 22" | 24" |
|---|---|---|---|---|---|---|---|
| 20" | 0.79 | 0.85 | 0.94 | 1.0 | 1.1 | 1.2 | 1.4 |
| 22" | 0.89 | 0.97 | 1.0 | 1.1 | 1.2 | 1.4 | 1.4 |
| 24" | 1.0 | 1.1 | 1.2 | 1.2 | 1.4 | 1.4 | 1.5 |

Example of Explosive Matrix Assembly TNT Conversion for RDX

The following exemplary calculation is for a 12"×12" Matrix using 80 grain RDX detonating cord. In most cases disposal technicians base the explosives energy of all explosives in relation to the explosives energy of TNT. The RE of RDX is 1.19, which means that one pound of RDX is equivalent to 1.19 pounds of TNT. Based on the below calculation a 12"×12" Matrix consisting of 33 feet of RDX detonating cord would be equivalent to 0.43 pounds of TNT. (33 Feet of Detonating Cord×0.011 Grains per Pound=0.36 Pounds per Matrix Charge, 0.36 Pounds per Matrix Charge×1.19 RE=0.43 TNT Equivalent) The below chart shows that as the size of the Matrix increases, so does the explosives energy in pounds of TNT.

TNT Equivalent for 80 Grain Matrix Charge (1.19 RE)

| | 12" | 14" | 16" | 18" | 20" | 22" | 24" |
|---|---|---|---|---|---|---|---|
| 12" | 0.43 | 0.49 | 0.56 | 0.64 | 0.74 | 0.83 | 0.94 |
| 14" | 0.49 | 0.56 | 0.63 | 0.70 | 0.80 | 0.90 | 1.0 |
| 16" | 0.56 | 0.63 | 0.70 | 0.78 | 0.88 | 0.96 | 1.1 |
| 18" | 0.64 | 0.70 | 0.78 | 0.88 | 0.95 | 1.1 | 1.2 |
| 20" | 0.74 | 0.80 | 0.88 | 0.95 | 1.1 | 1.1 | 1.3 |
| 22" | 0.83 | 0.90 | 0.96 | 1.1 | 1.1 | 1.3 | 1.3 |
| 24" | 0.94 | 1.0 | 1.1 | 1.2 | 1.3 | 1.3 | 1.4 |

NOTE: The above calculations are based on the use of one RE of PETN or RDX to TNT. The charts are exemplary and other RE values may be used, based on characteristics of the detonating cord.

Figure 5:
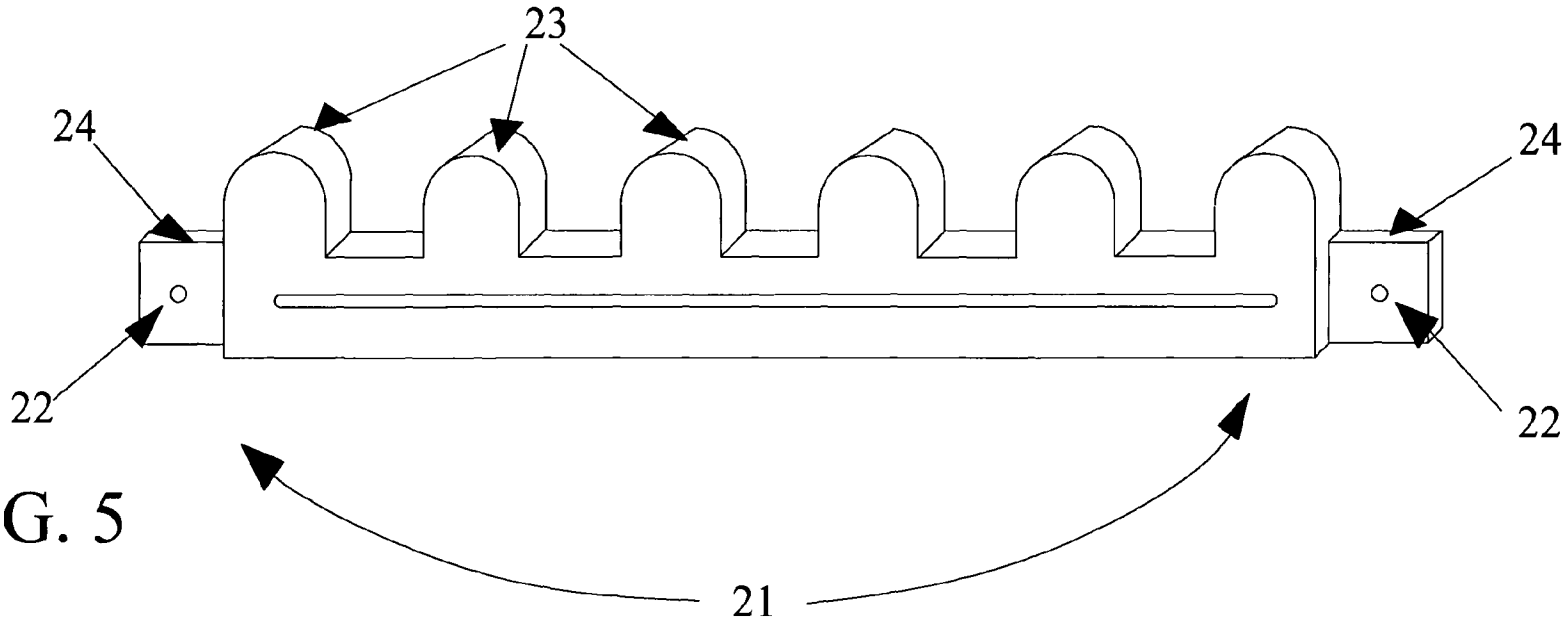
FIG. 5 depicts one of the eight identical pieces that comprise the assembly tool.
Figure 6:
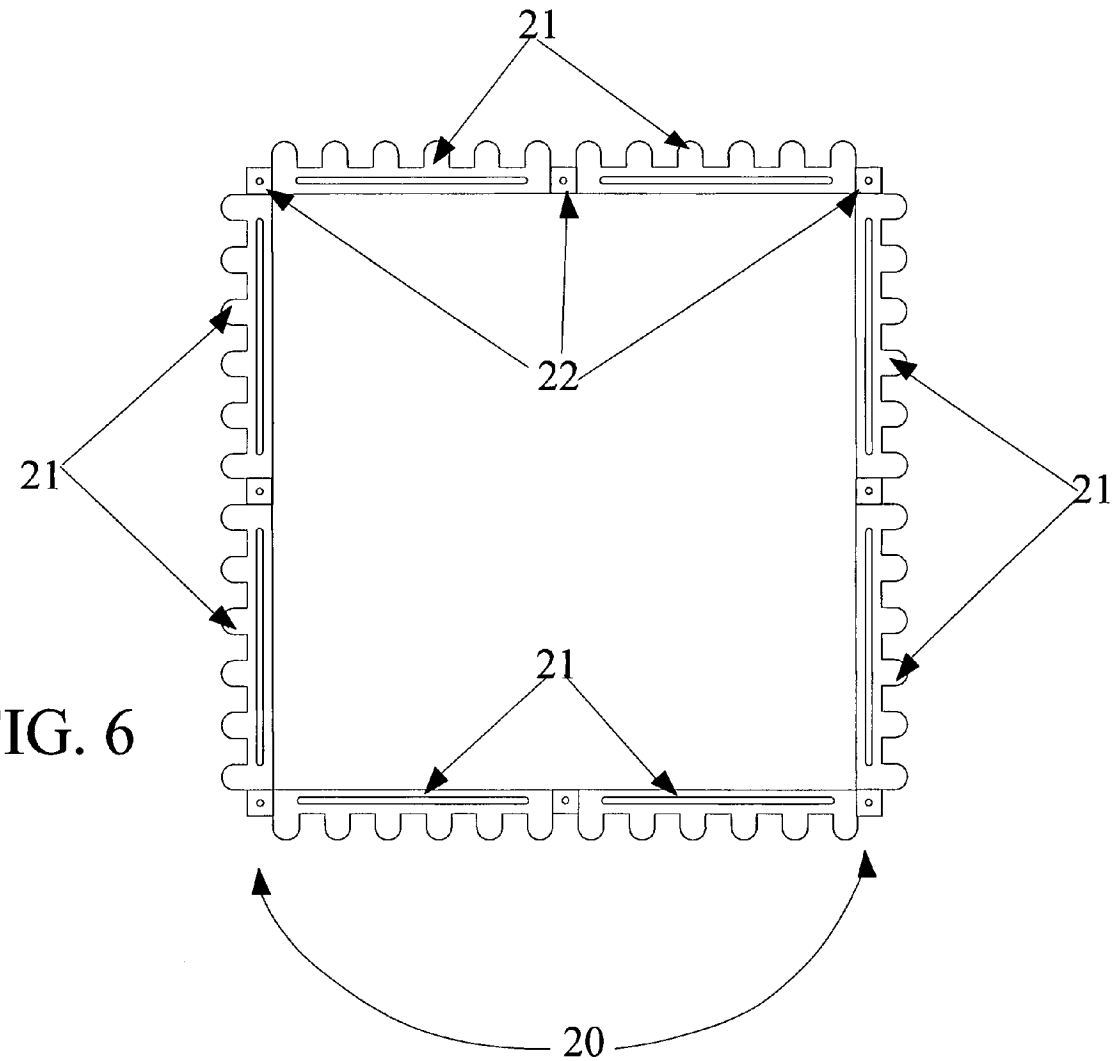
FIG. 6 depicts all eight pieces which comprise the preferred assembly tool that is used to construct an explosive matrix assembly.

In order to quickly and conveniently assemble the explosive matrix 1 in the field, an assembly tool 20, as depicted in FIG. 6, is used. The assembly tool is designed so that it may be carried disassembled to the place where it will be used to deploy the matrix. The assembly tool is preferably made of eight substantially identical pieces 21, as depicted in FIG. 5, plus appropriate assembly tool fasteners 22. Each of the eight pieces is generally flat and defines an elongated rectangle. At least three, and preferably six, side protrusions 23 emanate from one of the long edges. These side protrusions lie in the same plane as the plane defined by the elongated rectangle. Each of the side protrusions 23 is suitable for engaging detonating cord. An end protrusion 24 emanates perpendicularly form one of the short edges of the rectangle. This end protrusion is different from the side protrusions, but it does lie in the same plane as the plane defined by the elongated rectangle. This end protrusion 24 is designed to be removably secured by an assembly tool fastener 22 to the end protrusion 24 from an adjacent piece, with the original pieces 21 being generally perpendicular to each other. The mating end protrusions 24 from two adjacent pieces 21 must be offset so that the pieces 21 may lie in the same plane.

Each piece 21 is removably secured to another identical piece by the assembly tool fastener 22, with an appropriate overlap, so as to form one of the four sides of the rectangle defined by the eight assembled identical pieces. The end protrusions 23 will point longitudinally outward from the interior of the rectangle defined by the eight identical pieces.

Once the assembly tool 20 is erected, as shown in FIG. 6, it is used to assemble the explosive matrix, with the side protrusions 23 being used to hold the detonating cord 2 in place on the assembly tool. The technician should weave the detonating cord on the tool as shown in FIG. 1. A tail 5*a* should be allowed before starting the weave. The weave should be completed with two tails 5*a* and 5*b* at the starting point. The technician should secure the detonating cord tails 5*a* and 5*b* to the first weaving posts so that the tails stay in place. Either knots or cable ties may be used to secure the tails.

It is preferred for straight portions of detonating cord to be paired, so that each straight portion (or all but one) abuts another straight portion of detonating cord, leaving about two inches between pairs of parallel straight portions of detonating cord.

Once the weave is complete, cable ties 10 are placed along the four outermost straight portions of detonating cord to secure those straight portions to the straight portions of cord that intersect orthogonally. This secures the detonating cord matrix into the desired 90 degree angles. Except in the case of the last two rows, each cable tie 10 secures together four straight portions of detonating cord (two from one direction and two from the other direction). The last two rows will have three straight portions of detonating cord secured by each cable tie 10. Once all the outer edges have been cable tied, the technician may, at his option, either cable tie the other intersections or tape the middle.

Alternatives to the use of cable ties in the claimed invention include cord, tape, shrink wrap, or some combination or sub-combination of the three. However, cable ties are preferred due to the speed with which they can be applied, their cost, and their ready availability.

Once the matrix assembly 1 is complete, the technician should remove the assembly tool fasteners 22 in order to loosen the assembly tool 20, so that the matrix assembly 1 may slide off the assembly tool. If the area 13 to be used exceeds the area of a single matrix, a sufficient number of explosive matrix assemblies will be made and secured to one another by additional cable ties 11 to cover the entire area.

The explosive matrix assembly 1 is then placed over the explosive to be countered 12, as shown in FIG. 4. An initiator 6 is attached to the free ends of the tails 5*a* and 5*b*, as shown in FIGS. 1, 2, and 3. The explosive matrix may then be detonated by the explosive initiator 6. The overpressure wave may either destroy the target explosive directly, or it may cause a sympathetic detonation in the target explosive.

I claim:

1. An explosive matrix assembly comprising:

a single length of detonating cord, part of which is formed into a first set of at least five parallel portions that lie in a single plane, at least two parallel portions of said first set of parallel portions being paired, at least two parallel portions of said first set of parallel portions being spaced from each other, a further part of said single detonating cord being formed into a second set of five parallel portions that lie in a single plane, at least two parallel portions of said second set of parallel portions being paired, at least two parallel portions of said second set of parallel portions being spaced from each other, and the five parallel portions of said first set are substantially orthogonal to the five parallel portions of said second set.

2. An explosive matrix assembly according to claim 1, wherein at least one fastener secures at least one portion of said first set in abutment with at least one portion of said second set.

3. An explosive matrix assembly according to claim 2, wherein said explosive matrix assembly is fastened to a second explosive matrix assembly.

4. An explosive matrix assembly according to claim 2, wherein said single detonating cord contains no turns that are sufficiently sharp to significantly reduce the chances of detonation propagating through the turns.

* * * * *